United States Patent [19]

Bur et al.

[11] Patent Number: 4,764,650

[45] Date of Patent: Aug. 16, 1988

[54] MOLDED CASE CIRCUIT BREAKER WITH REMOVABLE ARC CHUTES AND DISENGAGEABLE TRANSMISSION SYSTEM BETWEEN THE OPERATING MECHANISM AND THE POLES

[75] Inventors: Marc Bur, Grenoble; Jean-Pierre Nebon, St. Martin Le Vinoux, both of France

[73] Assignee: Merlin Gerin, Grenoble, France

[21] Appl. No.: 919,434

[22] Filed: Oct. 16, 1986

[30] Foreign Application Priority Data

Oct. 31, 1985 [FR] France ..... 85 16345
Oct. 31, 1985 [FR] France ..... 85 16346

[51] Int. Cl.[4] ..... H01H 33/04; H01H 3/46

[52] U.S. Cl. ..... 200/153 G; 200/303; 200/148 C; 200/144 C; 200/281; 200/306

[58] Field of Search ..... 200/293, 271, 280, 272, 200/281, 273, 303, 148 R, 148 C, 144 R, 144 C, 306, 153 G, 153 SC

[56] References Cited

U.S. PATENT DOCUMENTS

| | | | |
|---|---|---|---|
| 2,727,111 | 12/1955 | Pokorny | 200/147 R |
| 3,004,125 | 10/1961 | Prien et al. | 200/281 X |
| 3,472,982 | 10/1969 | Duvall et al. | 200/144 R |
| 3,636,291 | 1/1972 | Norden | 200/293 |
| 3,821,607 | 6/1974 | Matsko et al. | 200/293 X |
| 4,139,754 | 2/1979 | Hofferberth | 200/281 |
| 4,277,664 | 7/1981 | Maier et al. | 200/293 |
| 4,527,027 | 7/1985 | Link et al. | 200/144 R |
| 4,613,734 | 9/1986 | Eckert et al. | 200/144 R |
| 4,679,016 | 7/1987 | Garcia et al. | 200/153 G X |

FOREIGN PATENT DOCUMENTS

| | | |
|---|---|---|
| 561334 | 10/1957 | Belgium . |
| 2062762 | 7/1972 | Fed. Rep. of Germany . |
| 2504007 | 8/1975 | Fed. Rep. of Germany . |
| 2451097 | 10/1980 | France . |
| 2042263 | 9/1980 | United Kingdom . |

*Primary Examiner*—Henry J. Recla
*Assistant Examiner*—Ernest G. Cusick
*Attorney, Agent, or Firm*—Parkhurst & Oliff

[57] ABSTRACT

A sub-assembly comprising a contact finger support cage and a connection pad of each pole is securedly united to an intermediate insulating partition of the case by a bracket and screw fixing device. The cage is pivotally mounted on a spindle positioned in bearings of the pad, and is connected to a switching bar by a mechanical link cooperating with a disengageable coupling, capable of breaking the linking system with the bar at the level of each pole. One side wall of the insulating case includes an opening communicating with the compartment housing the separable contacts of each pole. The arc chute is fixedly secured to an insulating support capable of being moved in translation in the longitudinal direction of the pole to ensure either blanking-off of the opening in the inserted position of the arc chute inside the compartment, or removal of the arc chute via said opening allowing the condition of the contacts of each pole to be checked visually, without removing the main fixing screws of the case.

10 Claims, 10 Drawing Sheets

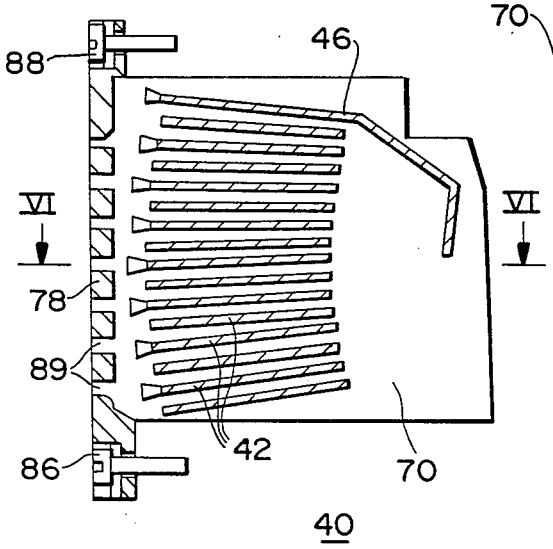
FIG. 4
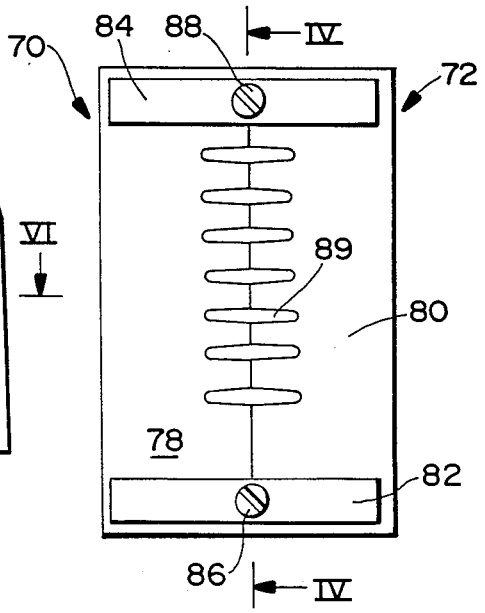
FIG. 5
FIG. 6
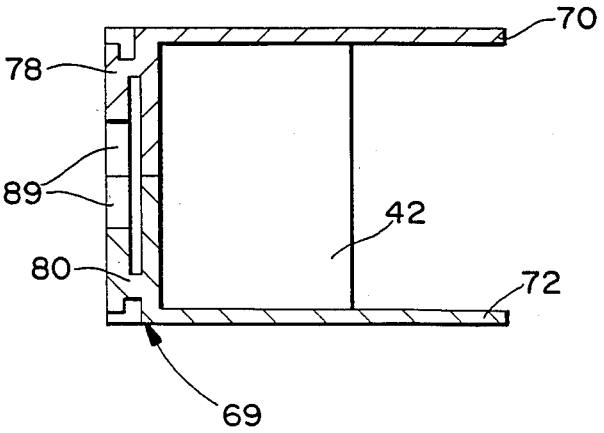

MOLDED CASE CIRCUIT BREAKER WITH REMOVABLE ARC CHUTES AND DISENGAGEABLE TRANSMISSION SYSTEM BETWEEN THE OPERATING MECHANISM AND THE POLES

BACKGROUND OF THE INVENTION

The invention relates to a multipole electrical circuit breaker with a molded insulating case, enclosing:

an operating mechanism having a toggle device coupled to a switching bar common to a plurality of juxtaposed poles inside the case with interposed insulating separation walls, a trip release cooperating with the mechanism in the event of a fault to bring about breaking of the circuit breaker by tripping of the mechanism and rotation of the bar, each pole comprising a pair of separable contacts having a series of elementary contact fingers cooperating with a stationary contact in the closed position, an arc chute, an insulating cage supporting the contact fingers, and a pair of connection pads electrically connected to the separable contacts.

In a range of molded insulating case circuit breakers for low voltage systems, a plurality of types of poles are involved the structure of which depends on various factors, notably the rating, breaking capacity, discrimination, etc. . . The choice of a circuit breaker is made in such a way that:

their rating is at least equal to the rated current of the feeder involved, their breaking capacity is at least equal to the short-circuit current calculated at the level considered, discrimination with the downstream protective switchgear unit can be ensured.

It is therefore necessary to provide a first series of standard circuit breakers for standard service conditions to be used when the short-circuit power of the system does not require a high breaking capacity and full discrimination is not called for, a second series of limiting circuit breakers with high breaking capacity and electrodynamic self-repelling contacts, and a third series of discriminating trip release circuit breakers having a good electrodynamic contact withstand. This variety of types of poles makes manufacturing and managing such a range of circuit breakers complicated, and this gives rise to stocking and assembly cost problems.

The object of the invention consists in improving management of manufacturing a range of insulating molded case circuit breakers, by quick interchangeability of the poles when assembly takes place.

SUMMARY OF THE INVENTION

The circuit breaker according to the invention is characterized, by the fact that the sub-assembly formed by the contact fingers, support cage and one of the connection pads of each pole is securedly united to a wall of the case, by means of a fixing device fixedly secured to the pad, and that the cage is linked to the bar by a mechanical link cooperating with a disengageable coupling device, capable of interrupting the kinematic transmission system with the bar at the level of each pole.

The coupling device of the mechanical link is located in a housing of the cage between a first retracted position, and a second retaining position corresponding respectively to uncoupling and coupling of said cage with the mechanical link.

Disconnecting the pad fixing device and separating the cage from the operating mechanism releases the moving contact sub-assembly which can be easily extracted via the rear of the case, and replaced by another sub-assembly of a different kind, so as to transform a standard circuit breaker into a limiting, discriminating or different rating circuit breaker. Different types of moving contact sub-assemblies merely have to be stocked, and a sub-assembly of a predetermined pole be fitted in a standard mechanism circuit breaker case in order to obtain the required switchgear unit.

The body of the insulating cage comprises an orifice giving access to the housing of the coupling device to allow the latter to be moved to the first retracted position against the force of a return spring. Actuating the disengageable coupling device to the retracted position is advantageously accomplished by means of a tool inserted in the orifice of the cage.

The contact fingers' support cage of each pole is pivotally mounted on the connection pad of the sub-assembly. The cage spindle is positioned in the bearings of a bracket securedly united to the pad, and the sub-assembly fixing screw passes through the bracket and is inserted in a hole of the case.

The sub-assembly cage advantageously constitutes an electrical and thermal shield between the upper compartment of the case enclosing the mechanism, and the lower compartment housing the poles. The cage also forms a barrier against pollution by the interruption gases.

The circuit breaker according to the invention enables the condition of the contacts to be checked and their wear to be assessed without removing the main insulating case assembly screws. One of the side walls of the insulating case comprises an opening communicating with the compartment housing the pair of separable contacts of each pole, and the arc chute is securedly united to an insulating support capable of being moved in translation in the longitudinal direction of the pole to accomplish either blocking off of said opening in the inserted position of the arc chute inside the case, or removal of the arc chute via said opening.

Visual checking of the condition of the contact is performed pole by pole after the corresponding arc chute has been removed, without disassembling the insulating case.

Each pole is advantageously equipped with a contact wear indicator formed by a visualization mark located on the insulating support cage of the moving contact. The latter comprises a plurality of contact fingers associated with contact pressure springs, each finger comprising an extension located near the mark formed for example by a half-open notch in the cage. The position of the end of the extension in relation to the mark determines the wear of the contacts.

BRIEF DESCRIPTION OF THE DRAWINGS

Other advantages and characteristics will become more clearly apparent from the following description of an embodiment of the invention, given as an example only, and represented in the accompanying drawings, in which:

FIG. 4 is an enlarged view of an arc chute, shown in cross-section according to the line IV—IV of FIG. 5;

FIG. 5 is a profile view of FIG. 4;

FIG. 6 represents a cross-sectional view according to the line VI—VI of FIG. 4;

DESCRIPTION OF THE PREFERRED EMBODIMENT

Figure 1:
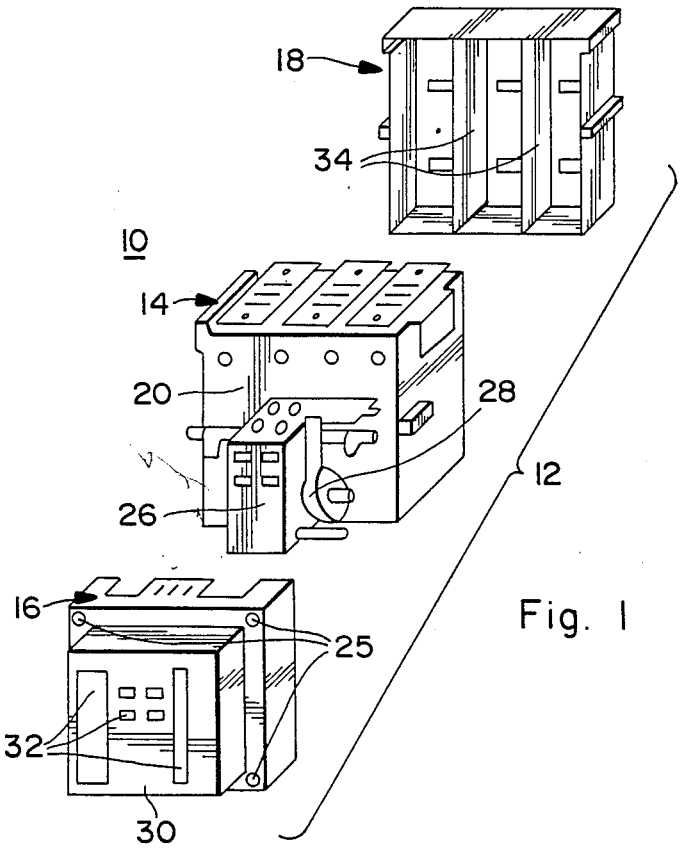
FIG. 1 is a perspective view of a three-phase circuit breaker, in the disassembled position of the case.

In FIGS. 1 to 6, a low voltage electrical circuit breaker 10 having a plurality of juxtaposed poles, comprises a parallelipipedic molded case 12 of an insulating material, formed by assembling an open-ended intermediate housing 14, a cover 16 shutting off the upper end and a base plate 18 shutting off the lower end. The intermediate housing 14 comprises an insulating subdivision partition 20, parallel to said ends and bounding an upper compartment 22 and a lower compartment 24 of the case 12. Final assembly of the case 12 is accomplished by means of main securing screws 23 passing through orifices 25 depthwise in relation to the case 12.

A stored energy operating mechanism 26 with a charging lever 28 is housed in the upper compartment 22 and is supported by the partition 20 of the intermediate housing 14. The front face 30 of the cover 16 has a plurality of orifices 32 for the charging lever 28 to pass through, on and off push-buttons, contact position indicating devices, and trip release adjustment means. A bar 33 or transverse switching shaft, common to all the poles, is actuated by the mechanism 26 to simultaneously drive the moving assembly of the different poles between the open and closed positions.

Figure 3:
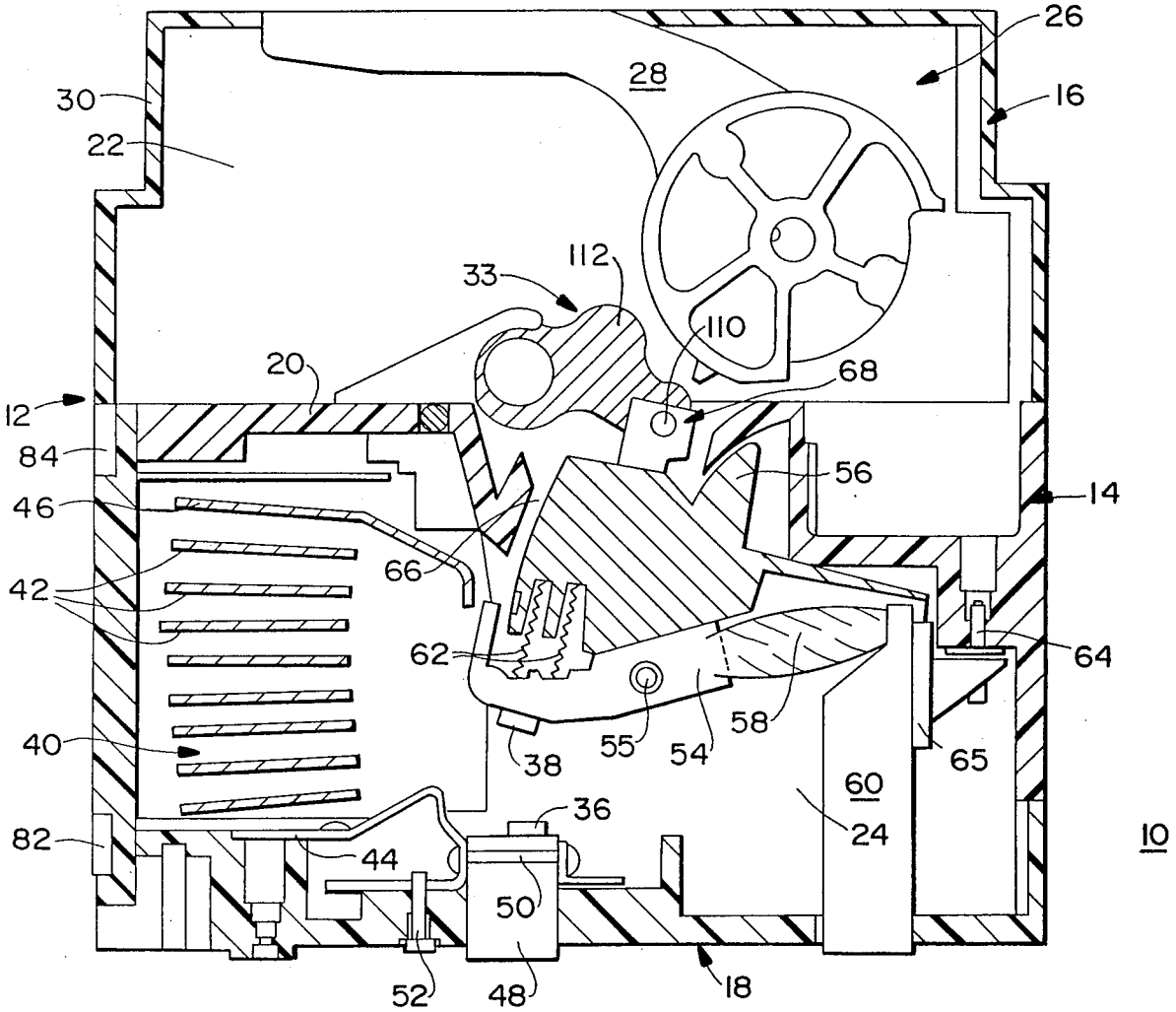
FIG. 3 shows a longitudinal sectional view of a pole of the circuit breaker, represented in the contact open position.

The lower compartment 24 is longitudinally subdivided by insulating walls 34 (FIG. 1) separating the poles, fixed to the base plate 18 extending perpendicularly to the partition 20 of the intermediate housing 14. In FIG. 3, each pole of the compartment 24 contacts a pair of separable contacts 36, 38 and an arc chute 40 equipped with a stack of metal plates 42 surrounded by a pair of lower 44 and upper 46 arc guiding horns. The stationary contact 36 is directly supported by a first connection pad 48 passing through the insulating base plate 18. The lower arcing horn 44 is fixed to the pad 48 and to the base plate 18 by fixing means 50, 52. The moving contact 38 sub-assembly 53 cooperating with the stationary contact 36 of each pole comprises a plurality of elementary contact fingers 54 linked by a transverse link member 55 and positioned in a support cage 56 made of insulating material. Each copper contact finger 54 is connected by a flexible conductor, notably a braid 58, to a second connection pad 60 of the pole, said pad 60 passing through the base plate 18 and extending parallel to the first pad 48 in the assembled position of the circuit breaker. Contact pressure springs 62 are inserted between the contact fingers 54 and the cage 56, and the second pad 60 is securedly united to the intermediate housing 14 by a screw 64 and bracket 65 assembly.

The intermediate partition 20 of the insulating case 12 extends over the whole surface of the housing 14 in such a way as to electrically insulate the lower compartment 24 from the upper compartment 22. An aperture 66 is located in the middle part of the partition 20 for the mechanical link 68 between the switching bar 33 and the cage 56 of each pole to pass through.

The arc chute 40 is aligned with the pair of separable contacts 36, 38, in the longitudinal direction of each pole. The structure of the arc chute 40 is shown in detail in FIGS. 4, 5, 6 and 15. The stack of metal arc deionization plates 42 is arranged on an insulating support 69 comprising two side flanges 70, 72. The internal face of each flange 70, 72 is provided with a plurality of ribs 74 bounding a succession of positioning grooves 76 of the opposing edges of the plates 42 and of the upper arcing horn 46. Each flange 70, 72 has associated with it by moulding a front fixing half-plate 78, 80, in such a way as to constitute a single insulating part. After the half-plates 78, 80 have been assembled, the arc chute 40 is held captive between the two side flanges 70, 72 positioning the plates 42, the support assembly 69 and arc chute 40 being held in place by means of two assembly clamps 82, 84. Two auxiliary fixing screws 86, 88 pass through the assembly clamps 82, 84 in the mid-plane of the junction of the two half-plates 78, 80, coplanar with the insulating support 69 of the arc chute 40. Exhaust slots 89 are provided in the half-plates 78, 80 to evacuate the interruption gases to the outside.

Figure 2:
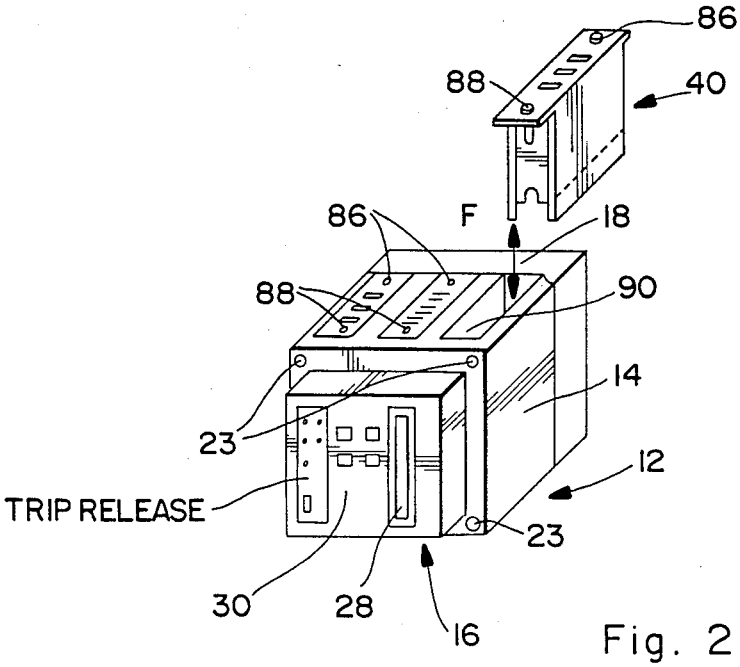
FIG. 2 is a perspective view of the circuit breaker in FIG. 1, in the assembled position of the case, and after the arc chute of one of the poles has been removed.
Figure 15:
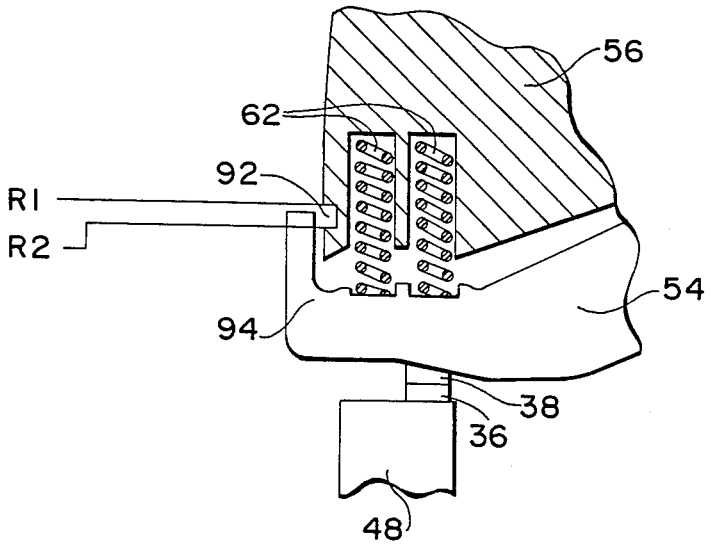
FIG. 15 is an enlarged scale view of a detail of FIG. 3, with the circuit breaker represented in the closed position.

It can be noted in FIG. 2 that removing an arc chute 40 by unscrewing the two auxiliary fixing screws 86, 88 of the support 69 associated with the right-hand pole, does not require removal of any of the main assembly screws 23 of the insulating case 12. The latter remains assembled and the arc chute 40 is extracted in the longitudinal direction (arrow F) of the pole, via a rectangular opening 90 disposed in the molded case 12. This opening 90 gives access to the lower compartment 24 is located at the level of each pole on a side wall of the insulating case 12, and enables the condition of the separable contacts 36, 38 to be checked when a maintenane operation is carried out on the circuit breaker. Removing the arc chute 40 facilitates in particular visual checking of the wear of the contact pads 36, 38 of each pole, by means of a visualization mark 92 on the corresponding cage 56 (FIG. 15). The mark 92 can be formed by a half-open notch bounded by two ridges R1 and R2. The front part of the contact fingers 54, situated between the moving contact 38 and the arcing horn 44, comprises an extension 94 whose end is located facing the mark 92 of the cage 56. The presence of the contact pressure springs 62 makes the relative position of the contact fingers 54 vary with respect to the cage 56 according to the wear of the contacts 36, 38. The wear is checked in the circuit breaker closed position after the stored energy mechanism 26 has been charged by means of the charging lever 28, and closing of the contacts 36, 38 has taken place by unlocking the closing pawl (not shown). Maximum wear of the contacts 36, 38 is attained when the end of the extension 94 coincides with the ridge R2 of the mark 92. The pole contacts must then be replaced without fail. The condition and penetration of the contacts are satisfactory when the end of the extension 94 is situated in the gap between the two ridges R1 and R2 of the mark 92. This visual check of the wear of the contacts 36, 38 does not require the case 12 or the mechanism 26 to be disassembled at all and can be carried out pole by pole, by simply unscrewing the two fixing screws 86, 88 of the support 69 and extracting the corresponding arc chute 40.

After the condition of the contacts 36, 38 has been checked, the support 69 and arc chute 40 assembly in a single block is fitted in the longitudinal direction of the pole via the lateral opening 90 of the lower compartment 24 in the direction of the contacts. After the arc chute 40 has been fitted, the insulating support 69 is blocked in translation by tightening the auxiliary screws 86, 88, and the upper arcing horn 46 is perfectly positioned with respect to the contact fingers 54 of the moving assembly. The two half-plates 78, 80 coplanar with and joined to the insulating support 69 make up a wall blocking off the rectangular opening 90 of the lower compartment 24. One of the auxiliary fixing screws 86 is screwed into an orifice of the base plate 18, whereas the other fixing screw 88 is inserted in an orifice of the intermediate housing 14. In the inserted position of the arc chute 40, the blocking-off wall presents a plane surface continuous with the remaining side wall of the insulating case 12. The presence of the slots 89 in this wall enables the interruption gases to escape to the outside.

In FIGS. 7 to 10, the insulating cage 56 comprises a plurality of recesses 98 housing the contact fingers 54, and is bounded laterally by two parallel flanges 100, 102 extending in the longitudinal direction of the pole. Each flange 100, 102 bears a spindle 104 positioned in a corresponding bearing 106 of the fixing bracket 65 of the second connection pad 60. When the bracket 65 is assembled by means of screw 64 on the housing 14, the cage 56 is pivotally mounted on the pad 60 in the course of the rotating movement of the switching bar 33 actuated by the mechanism 26.

Figure 9:
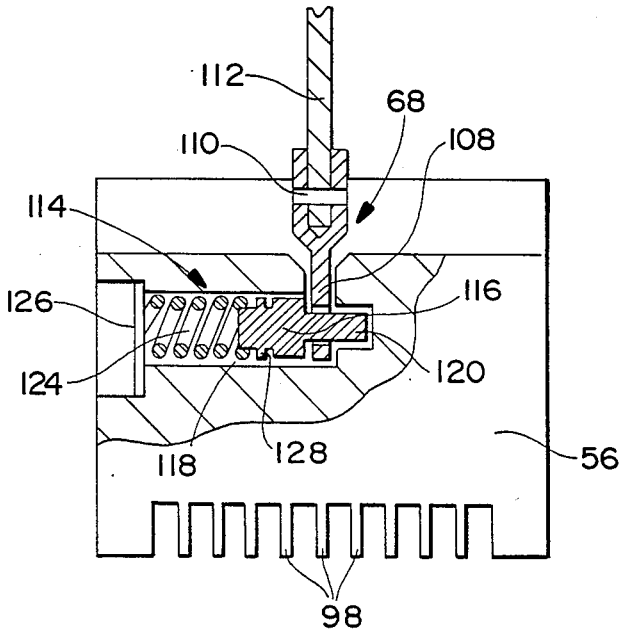
FIGS. 9 and 10 are cross-sectional views according to the line IX—IX of FIG. 8, respectively in the coupled position and in the retracted position of the mechanical link coupling device.
Figure 10:
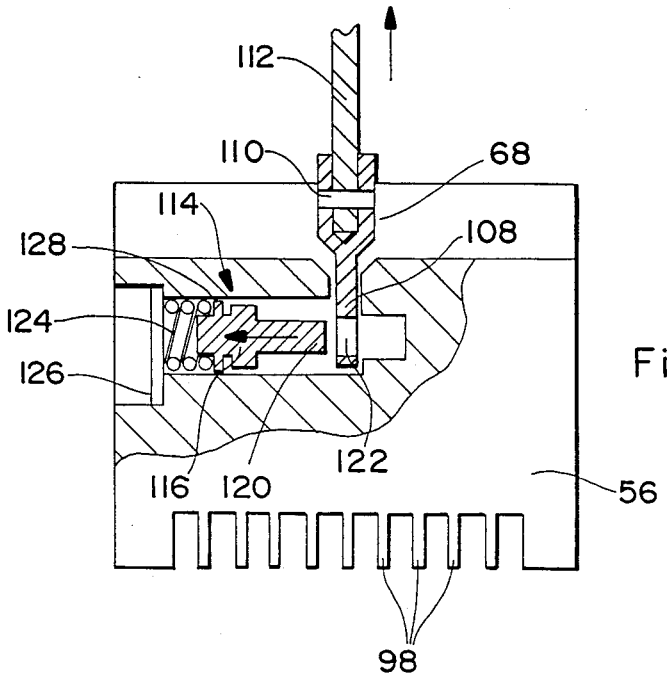

The mechanical link 68 between the switching bar 33 and the cage 56 of each pole is formed by a correcting or transmission rod 108 articulated on a spindle 110 of a crank-handle 112 keyed onto the bar 33. The end of the rod 108 situated opposite the spindle 110 cooperates with the retractable coupling device 114 arranged inside the cage 56. The coupling device 114 comprises a slide 116 mounted with limited sliding in a cylindrical housing 118 of the cage 56 and extending perpendicular to the transmission rod 108. One of the ends of the slide 116 is extended by a coupling pin 120 designed to engage in an orifice or hole 122 of the rod 108 by the action of a compression spring 124 (FIG. 9). The latter extends coaxially inside the housing 118 and is inserted between the slide 116 and a plug 126 blanking off the housing 118, situated opposite the coupling pin 120. The slide 116 is in addition provided with an annular groove 128 in which a tool (not represented) can be fitted capable of driving the coupling device 114 in translation to the retracted position, against the force of the spring 124 (FIG. 10). The mechanical link 68 between the bar 33 and the cage 56 is then interrupted, enabling the moving contact sub-assembly 53 to be disassembled. The mechanism 26 remains in place in the upper compartment 22, but is mechanically detached from the moving assembly of the pole. The tool is fitted in the groove 128 of the slide 116 via a rectangular orifice 130 in the body of the cage 56 (see FIG. 7) facing the movable slide 116.

The presence of the disengageable coupling device 114 at the level of the mechanical link 68 of each pole with the common bar 33, makes assembly and interchangeability of the poles of the circuit breaker 10 easier.

CIRCUIT BREAKER POLE ASSEMBLY

Figure 11:
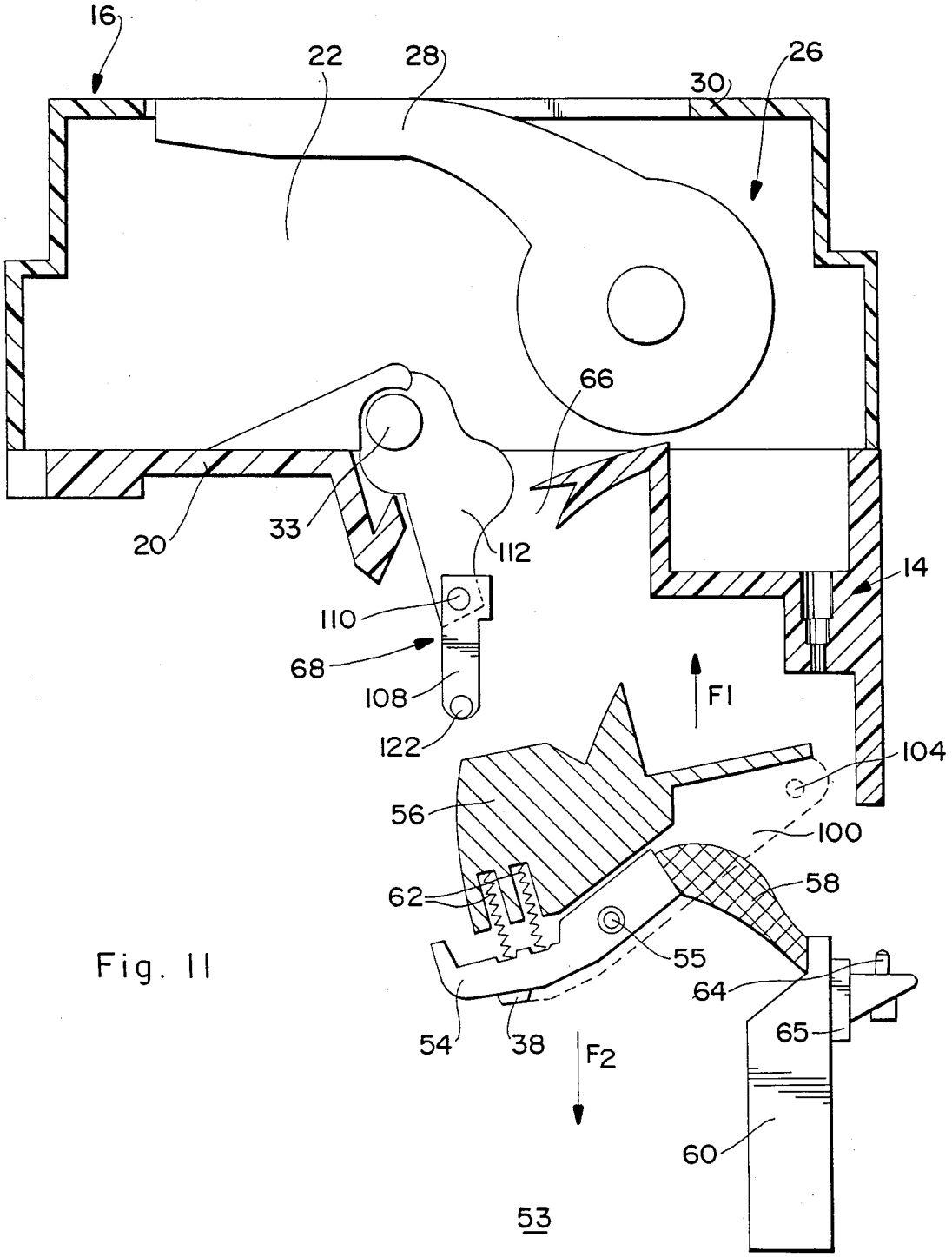
FIG. 11 is a similar view to that of FIG. 3, on disassembly and assembly of the moving contact sub-assembly.

Assembly of a pole is illustrated in FIG. 11, after the mechanism 26 and the bar 33 have been fitted in the upper compartment 22 of the case 12. The moving contact sub-assembly 53 is fitted via the rear of the case 12 after the base plate 18 and arc chutes 40 of the different poles have been removed. The moving contact sub-assembly 53 of each pole comprises the cage 56, the contact fingers 54 with their respective braids 58 and contact pressure spings 62, and the second connection pad 60 equipped with the fixing bracket 65. The pivoting spindle 104 of the cage 56 is positioned in the bearings 106 of the bracket 65 and the moving contact sub-assembly 53 is moved in the direction of the arrow F1 and fixed to the lower face of the partition 20 of the intermediate housing 14 by means of the screw 64 fitted through the bracket 65 of the connection pad 60. After the screw 64 has been tightened, coupling of the mechanical link 68 to the cage 56 takes place with the mechanism 26 in the open discharged position. This operation requires the bar 33 to be actuated manually to the closed position, and the coupling device 114 to be moved by means of a tool to the retracted position in FIG. 10, to allow the transmission rod 108 to be fitted. The tool neutralizing the coupling device 114 is inserted via the opening 90 of the case 12 and via the orifice 130 of the cage 56. Releasing the slide 116 then causes the coupling pin 120 to enter the orifice 122 of the rod 108, due to the decompression of the spring 124. At the end of the coupling operation of the mechanical link 68, counterclockwise rocking of the bar 33 takes place to the open position, represented in FIG. 3.

The stationary contact sub-assembly of each pole comprising the first connection pad 48 and the stationary contact 36 associated with the lower arc guiding horn 44 is then fixed to the internal face of the base plate 18 by tightening the fixing means 50, 52 (FIG. 3). Final assembly of the poles results from the assembling the cover 16 and base plate 18 on the intermediate housing 14 by means of the main screws 23 of the case 12.

The stored energy device of the mechanism 26 is then charged by means of the charging lever 28 to bring about closing of the circuit breaker, followed by a check of the penetration of the contacts 36, 38 of the different poles. Final assembly of the circuit breaker 10 takes place after the arc chutes 40 have been inserted in the lateral openings 90 of the assembled case 12 (see FIG. 2).

In the assembled position of the circuit breaker, the presence of the insulating cage 56 in the aperture 66 of the partition 20, allowing movement of the mechanical link 68 of each pole, forms an electrical and thermal shield between the two compartments 22, 24 of the case 12. This results in the operating mechanism 26, accessible from the front face 30, being perfectly insulated electrically from the live parts in the different poles. When the cage 56 pivots on the spindle 104 securedly united to the pad 60 between the open (FIG. 3) and closed (FIG. 12) positions of the contacts 36, 38, the aperture 66 remains permanently blanked off, so as to ensure a tight sealing between the two compartments 22, 24. Any pollution in the upper compartment 22 is thus avoided following the effects of arc interruption in the poles of the lower compartment 24. A toroid current transformer is fitted around the pad 60, supported by the base plate 18, inside the compartment 24.

INTERCHANGEABILITY OF POLES

Figure 13:
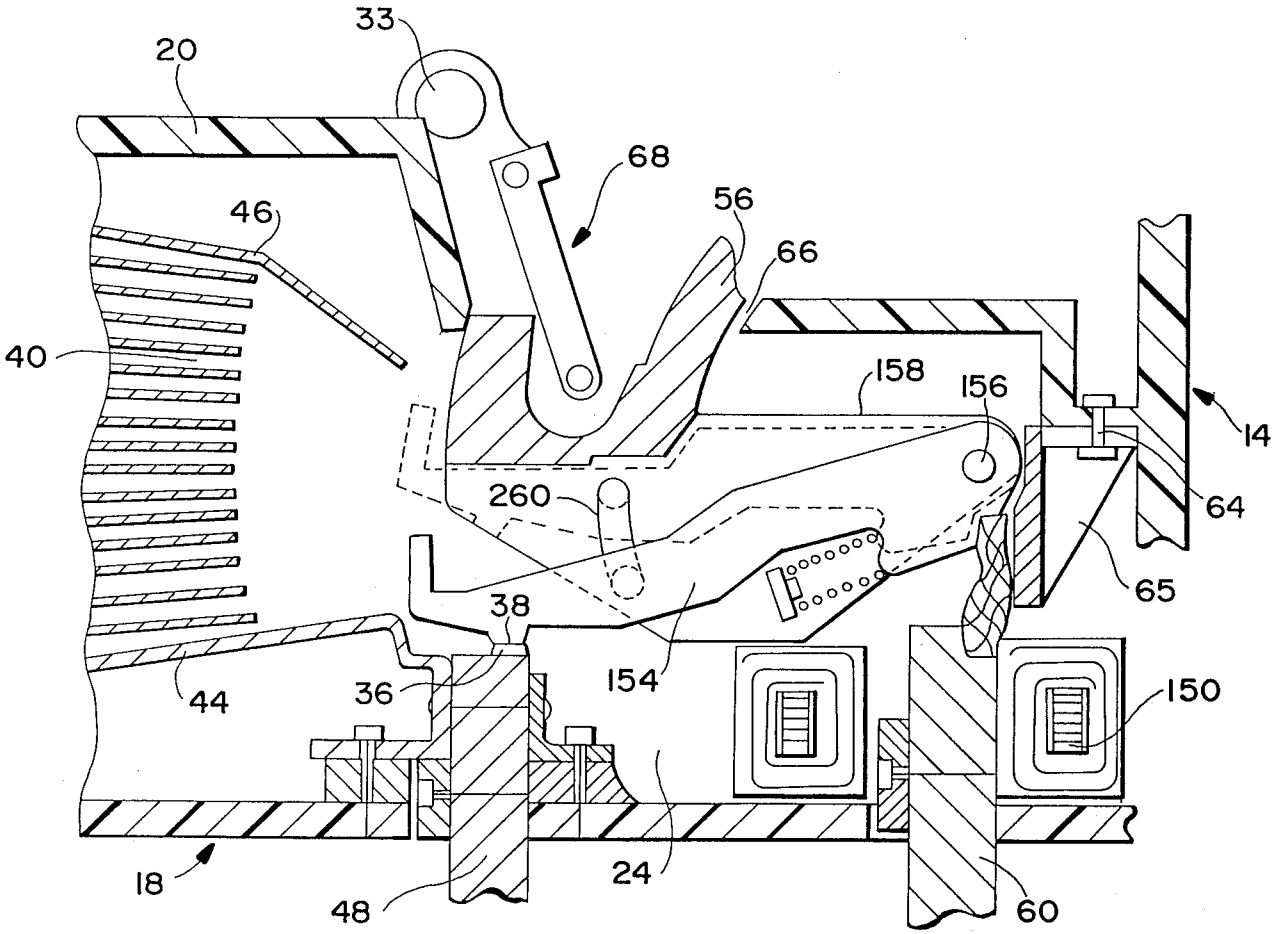
FIG. 13 is an identical view to that of FIG. 12, representing another type of sub-assembly for a current limiting pole.
Figure 14:
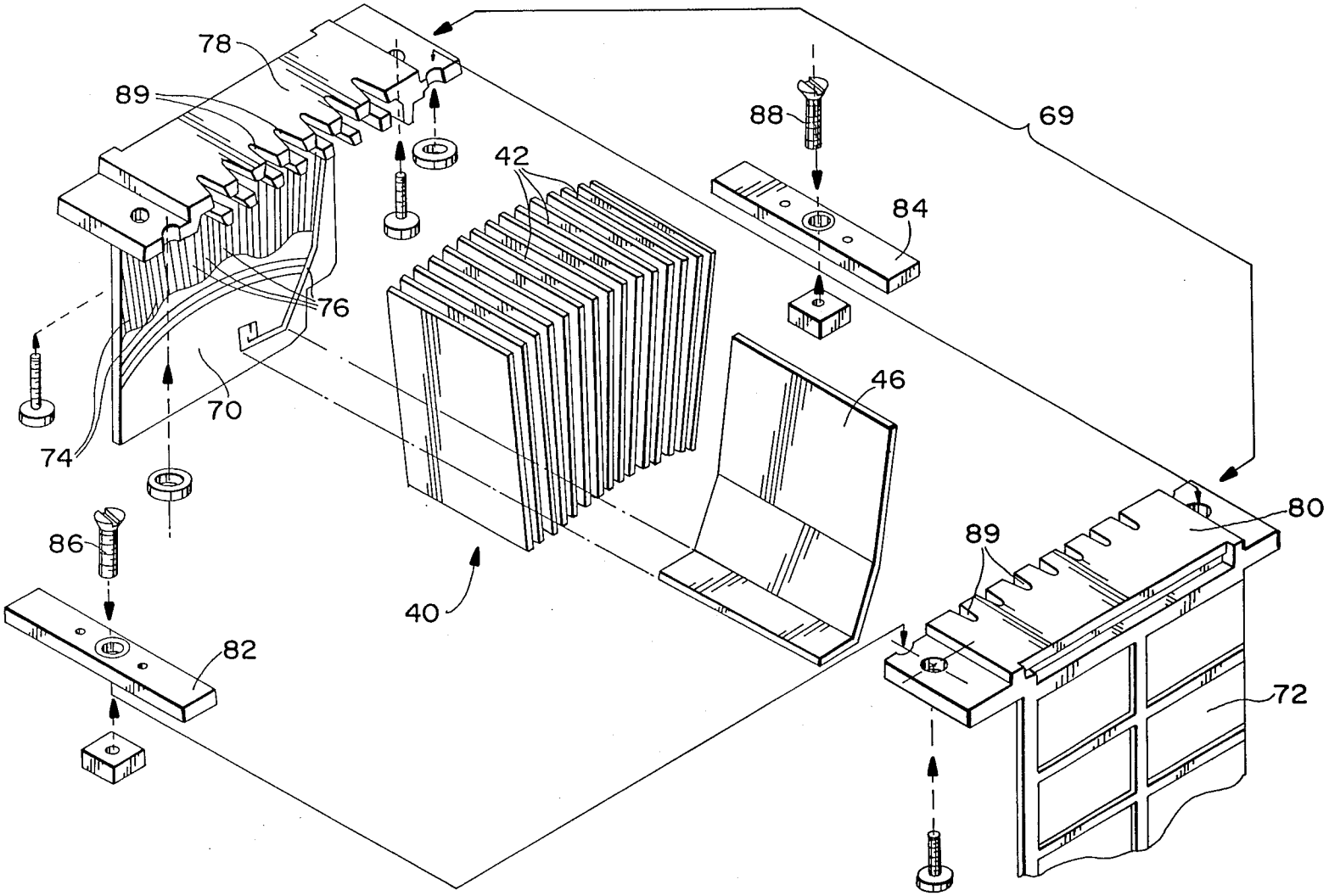
FIG. 14 is an exploded perspective view of an arc chute of FIG. 4.

Depending on the breaking performances and electrical characteristics of a range of circuit breakers, it is easy to adapt to fitting specific poles in the lower compartment 24. FIG. 13 shows fitting of a current limiting pole, comprising electrodynamic repulsion effect contacts 36, 38. The contact fingers 154 are pivotally mounted on a transverse spindle 156 borne by a support 158 fixed to the insulating cage 56. The support 158 is provided with a curved guiding groove 260 whose length corresponds to the electrodynamic repulsion travel of the fingers 154, when a short-circuit current occurs in the pole. Opening of the contacts 36, 38 by electrodynamic repulsion (in dashed lines in FIG. 13) is then confirmed by tripping of the mechanism 26 causing the bar 33 to rotate counterclockwise and final opening of all the poles of the circuit breaker 10.

Figure 12:
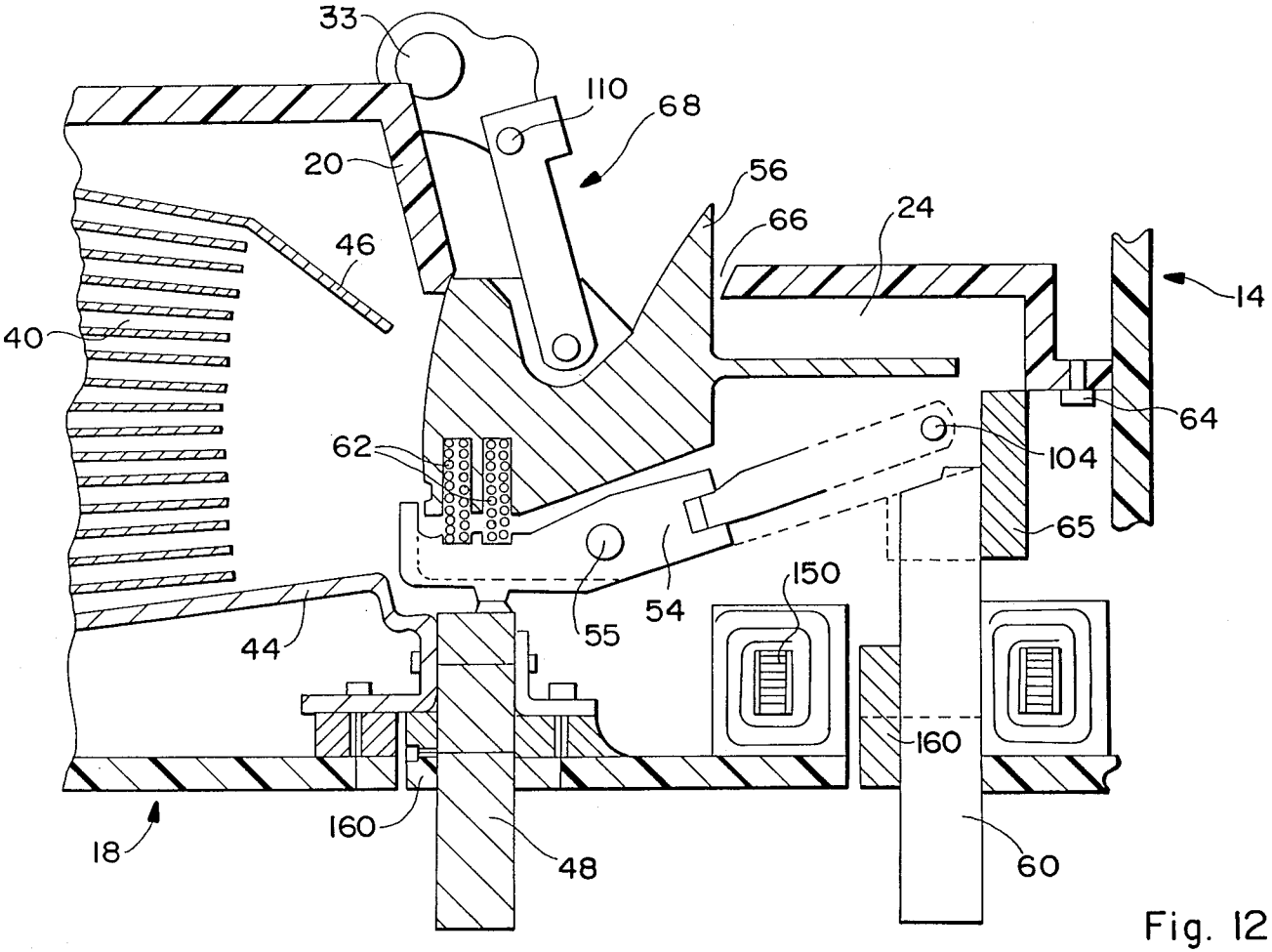
FIG. 12 is a partial view of FIG. 3 in the closed position of the circuit breaker.

Fitting of the limiting pole in FIG. 13 is accomplished in the same way as that used for the pole in FIGS. 3, 11 and 12, after the bracket 65 has been fixed to the intermediate housing 14, and after the mechanical link 68 has been coupled (FIGS. 7 to 10).

Removal of the poles of the circuit breaker 10 is performed in the reverse order to the assembly described hereabove, after the base plate 18 of the case 12 and the arc chutes 40 have been removed. The moving contact sub-assembly 53 is removed in the direction of the arrow F2 (FIG. 11) after the screw 64 has been unscrewed, and the mechanical link 68 uncoupled from the bar 33. Any other type of pole can of course be fitted to the circuit breaker according to the breaking capacity and circuit protection and control functions.

Figure 7:
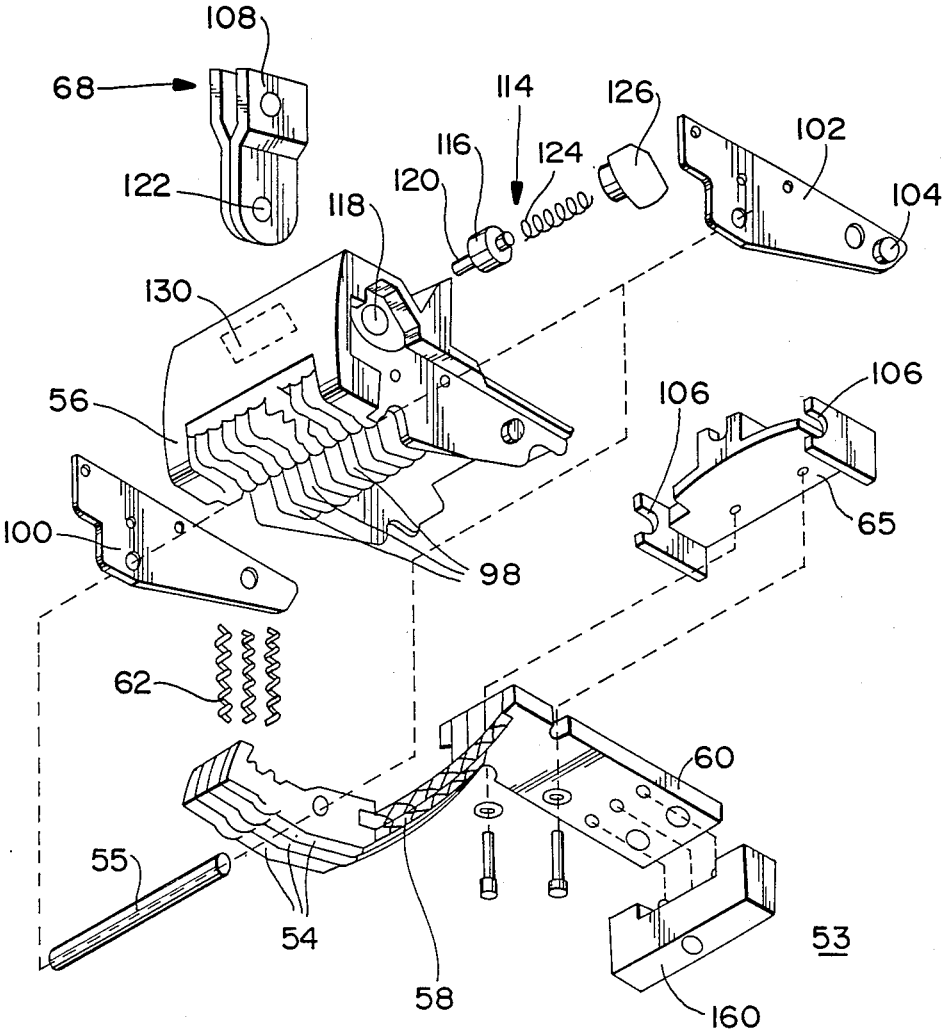
FIG. 7 is an exploded perspective view of a moving contact sub-assembly of a pole.
Figure 8:
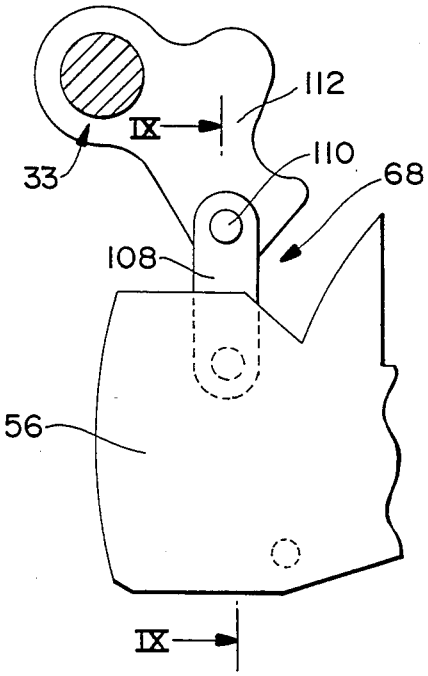
FIG. 8 is a partial view of FIG. 3 showing the kinematic transmission system between the bar and the cage of a pole.

According to FIGS. 7 and 12, the connection pads 48, 60 of each pole are advantageously equipped with positioning wedges 160 able to be fitted in the recesses of the base plate 18. The dimensions of the recesses are identical for the whole range, and the thickness of the wedges 160 varies in terms of the rating. This arrangement makes it possible to use a standard insulating case 12, and to fit pads of different cross-sections in any one recess for ratings from 800 A to 4000 A.

The scope of the invention is naturally not restricted to the embodiment more particularly described and represented in the accompanying drawings, but can on the contrary be extended to include any equivalent alternative embodiment, notably in which the retractable coupling device 114 in FIGS. 7 to 10 is replaced by any other mechanical disengagement device between the bar 33 and the poles.

What we claim is:

1. A multipole electrical circuit breaker comprising:

a molded insulating case including an inner partition wall of insulating material, said case enclosing:

an operating mechanism for activating said circuit breaker between open and closed positions;

a plurality of poles located side-by-side with interposed insulating separation walls;

each pole having a pair of separable contacts comprising a stationary contact cooperating in the closed position of the circuit breaker with a plurality of elementary movable contact fingers;

a transverse rotatable switching bar common to all the poles and coupled to said operating mechanism for driving simultaneously the movable contact fingers of each pole between the open and closed positions;

an arc chute for extinguishing an arc drawn in each pole between said movable contact fingers and the stationary contact in the open position;

an insulating cage for supporting the movable contact fingers of each pole;

a pair of first and second connection pads electrically connected respectively to the stationary contact and to the movable contact fingers of each pole;

said cage and the second connection pad forming a sub-assembly which is securedly united to said partition wall of the case;

a fixing device associated to said second connection pad for attachment of said sub-assembly to the partition wall; and a mechanical transmission link interconnecting the insulating cage with said switching bar by means of a disengageable coupling device which can be operated between a first retracted position for disengaging said link, and a second retaining position for establishing said link between the bar and the cage.

2. A multipole electrical circuit breaker according to claim 1, having:

an open-ended intermediate housing of the insulating case comprising said partition wall defining an upper end and a lower end;

a cover shutting off the upper end of said housing;

a base plate shutting off the lower end of said housing which extends parallel to said cover and base plate so as to define an upper compartment housing said operating mechanism and a lower compartment housing the poles; and an aperture located in said subdividing partition for the mechanical link of each pole to pass through, said cage being disposed in the lower compartment to blank off said aperture in such a way as to form an electrical, thermal and anti-pollution shield between the upper and lower compartments of the case.

3. A multipole electrical circuit breaker according to claim 2, including a positioning wedge associated with the connection pads of each pole, said wedge having a predetermined thickness according to the selected rating current of the circuit breaker, said connection pads extending parallel to one another and passing through the base plate perpendicularly to the partition wall.

4. A multipole electrical circuit breaker according to claim 2, comprising main fixing screws for assembling the intermediate housing to the cover and base plate, each pole including further:

an opening arranged in a side wall of the insulating case for communicating with the lower compartment; and a removable insulating support for supporting the arc chute, and capable to be moved in translation through said opening along a longitudinal direction of the pole, allowing the arc chute to be drawn out from the lower compartment via said opening, so as to check the wear of the contacts without removing said main fixing screws.

5. A multipole electrical circuit breaker according to claim 4, including a plurality of metal plates arranged in the arc chute of each pole, said removable support comprising:

a pair of positioning flanges for supporting said metal plate;

a front mixing wall capable of adaption to said opening when the arc chute is inserted within said lower compartment; and at least one auxiliary screw for blocking the insulating support to the case when the opening has been blanked off by said front wall.

6. A multipole electrical circuit breaker according to claim 5, including:

a plurality of exhaust slots located in the front fixing wall to communicate the lower compartment with an outside environment;

a succession of plate positioning grooves arranged in each flange;

a half-plate linked by molding to each flange to form a single insulating part; and a pair of fixing clamps for assembling the two symmetrical parts bringing about securing of the metal plates and the coplanar junction of the two half-plates.

7. A multipole electrical circuit breaker according to claim 4, having:

a visualization mark formed by a half-open notch located on the cage to enable the contact wear to be checked from the opening after removal of the arc chute; and an extension of each movable contact finger moving along said notch according to the wear of the contacts.

8. A multipole electrical circuit breaker according to claim 1, further including:

a housing located in the cage for lodging said coupling device;

an orifice arranged in the cage for giving access in the housing so as to allow the coupling device to be moved to the first retracted position; and a return spring urging said coupling device to the second retaining position.

9. A multipole electrical circuit breaker according to claim 8, wherein the housing has a cylindrical shape and further comprising:

a movable slide mounted with limited sliding in said housing of cylindrical shape;

a connecting rod of said mechanical link extending perpendicularly to said slide, said connecting rod being provided with a hole;

an extension of said slide being arranged as a coupling pin which is inserted in said hole of the connecting rod in said second retaining position;

a plug situated opposite the coupling pin for blanking off the housing; and said return spring including a compression spring inserted between the slide and said plug.

10. A multipole electrical circuit breaker according to claim 1, comprising:

a spindle for pivotally mounting said cage on the second connection pad in the second retaining position of the coupling device;

a bracket securedly fixed to the second connection pad;

a securing screw passing through the bracket;

an attachment hole arranged in said partition wall, said screw being introduced into said hole for the attachment of the sub-assembly to said partition wall; and bearing means fixed to said bracket so as to form the spindle of the cage.

* * * * *